US006877420B2

(12) United States Patent
Sickels

(10) Patent No.: US 6,877,420 B2
(45) Date of Patent: Apr. 12, 2005

(54) STRAPPING MACHINE WITH RETAINED PROGRAM TIMERS FOR SAFETY INTERLOCKS AND METHOD

(75) Inventor: Lawrence G. Sickels, Spring Grove, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 10/446,590

(22) Filed: May 28, 2003

(65) Prior Publication Data

US 2004/0237806 A1 Dec. 2, 2004

(51) Int. Cl.[7] ..... B65B 13/02; B65B 57/10

(52) U.S. Cl. ..... 100/2; 100/4; 100/26; 100/29; 100/99

(58) Field of Search ..... 100/2, 4, 26, 29, 100/30, 32, 33 PB, 44, 99; 53/64, 77, 399, 589; 192/129 R, 129 A; 700/79, 177

(56) References Cited

U.S. PATENT DOCUMENTS

| | | | | |
|---|---|---|---|---|
| 3,698,310 A | * | 10/1972 | Plattner et al. | 100/4 |
| 3,913,472 A | * | 10/1975 | Buck | 100/4 |
| 6,038,967 A | * | 3/2000 | Chak et al. | 100/2 |
| 6,629,398 B2 | * | 10/2003 | Pearson et al. | 53/64 |

* cited by examiner

*Primary Examiner*—Allen Ostrager
*Assistant Examiner*—Jimmy Nguyen
(74) *Attorney, Agent, or Firm*—Mark W. Croll, Esq.; Donald J. Breh, Esq.; Welsh & Katz, Ltd.

(57) ABSTRACT

A method and control system for a strapping machine restarts the strapping machine at a point of interruption of the strapping machine cycle. The system and method determines the presence of a foreign object proximal the strapping machine during the strapping cycle, interrupts the strapping cycle upon determining the presence of the foreign object proximal the strapping machine during the strapping cycle, determines a point of interruption of the strapping cycle and restarts the strapping cycle at the point of interruption through the use of retained program timers.

9 Claims, 1 Drawing Sheet

STRAPPING MACHINE WITH RETAINED PROGRAM TIMERS FOR SAFETY INTERLOCKS AND METHOD

BACKGROUND OF THE INVENTION

The present invention is directed to a strapping machine having retained program timers. More particularly, the present invention is directed to a strapping machine that includes retained program timers in the event of cycle interruption.

Strapping machines are used in a wide variety of applications. In one such application, a strapping machine is incorporated into a stacker system that allows for the stacking of, for example, magazines and the like into a stack of such items for easy handling. A typical stacker conveys the material from a supply into a stacking path. The materials are then stacked onto a rigid element, such as a sized sheet of plywood and onto one another. The stacker assures alignment of the edges of the stacked materials to permit handling efficiency and to reduce the damage that could otherwise occur to the materials. The stacked materials are then compressed and a strap is applied around the materials to secure the stacked and bundled materials into a "log".

The strapping machine is positioned along the length of the stacker at a location at which it is essentially a freestanding, fully independent component. In such an arrangement, the strapping machine is essentially integrated into the stacker for independent operation. In that stackers vary from one manufacturer to another, a variety of strapping machines and/or a single, versatile strapping machine must be configured for insertion into the stacker to integrate with the overall stacking and bundling operation.

In a typical arrangement, the stacker is configured having an elongated frame that can extend over twenty to thirty feet in length. The strapper is usually installed in the stacker frame near the mid-point of the frame. As such the strapper is not near to an end of the frame so that it is readily accessed. Rather, typically, access to the strapper requires that an operator walk around the rear of the machine to carry out any actions that are needed.

Operation of such a stacker/strapper machine is typically automatic with certain manual operator actions required. For example, the stacking of the product (e.g., magazines or more generally paper) is an automatic operation. The movement of the stack or bundle into the strapper is also an automatic operation. Likewise, the strapping and subsequent movement out of the strapper region is an automatic operation.

However, in order to reduce the potential for operator injury, there are various sensors located on the machine-that prevent operation or interrupt the strapping cycle in the event that an object passes through or beyond a barrier. These sensors are part of an interlock system that shuts down the strapper upon receipt of one or more signals. For example, in the event that an object enters the strapper region (e.g., near the strap chute), regardless of the point at which the cycle is, "breaking" the sensor path will generate a signal to stop the strapper. Even if it is in mid-cycle. However, in order to restart the strapper, a manual clearing and re-cycling of the strapping machine is required. This is so, even if the cycle was interrupted due to an inadvertent crossing of the sensor path.

While such interlocks provide a necessary and desirable safety enhancement, the inadvertent activation of the safety interlock system can result in unnecessary and costly equipment down time.

Accordingly, there exists a need for a strapping machine program that accommodates safety interlocks, but also reduces the amount of unnecessary equipment downtime. Desirably, such a system includes retained program timers to restart the strapping cycle at the point at which the cycle was interrupted.

BRIEF SUMMARY OF THE INVENTION

A system and method for restarting a strapping machine that has been interrupted during a strapping cycle restarts the strapping machine at the point at which the cycle was interrupted. Such a system is configured for use in a strapping machine of the type having a feed assembly, a chute, a strapping head and a control system.

A strapping cycle includes starting the strapping cycle, conveying a strapping material into the strapping head, into and around the chute and to exit the chute and return to the strapping head. The cycle includes receiving first and second courses of strapping material at the strapping head, positioning the strapping material around a load, tensioning the strapping material around the load, sealing the strapping material onto itself and severing the strapping material from a strapping material source.

The method for restarting the strapping machine includes the steps of detecting that the strapping cycle has been interrupted, determining a point of interruption of the strapping cycle and restarting the strapping cycle at the point of interruption.

The method can include the step manually actuating a switch to restart the strapping cycle. Such a method can be used to detect the presence of a foreign object at the strapping machine chute and interrupt the strapping cycle based upon the presence of the foreign object.

The breaching of a light curtain can be used to detect the presence of a foreign object.

A control system for a strapping machine includes means for determining the presence of a foreign object proximal the strapping machine during the strapping cycle, means for interrupting the strapping cycle upon determining the presence of a foreign object proximal the strapping machine during the strapping cycle, means for determining a point of interruption of the strapping cycle and means for restarting the strapping cycle at the point of interruption. The means for determining the point of interruption of the strapping cycle is preferably a retained program timer.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
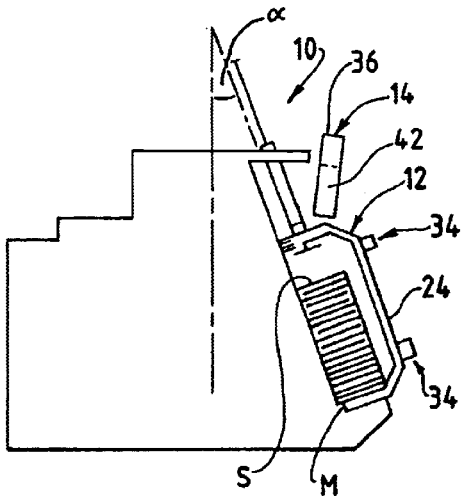
FIG. 1 is a schematic side view illustrating an exemplary stacker having an integral strapping machine that includes retained program timers for safety interlocks embodying the principles of the present invention.
Figure 2:
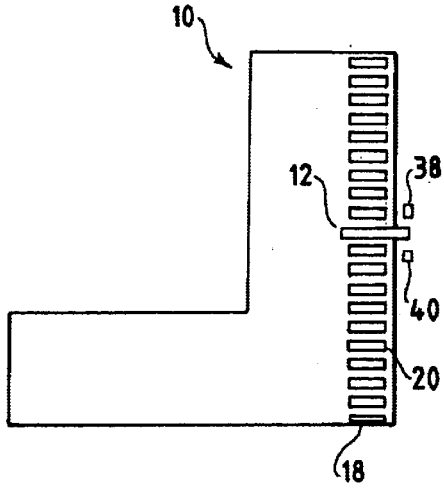
FIG. 2 is a top view of the exemplary stacker of FIG. 1.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring now to the figures in particular to FIG. 1 there is illustrated, generally, a stacker 10 having an integrated, modular strapping machine or strapper, indicated generally at 12. The strapper 12 includes a control system 14 that includes retained timers for safety interlocks in accordance with the principles of the present invention.

Referring again to the stacker 10, the exemplary stacker 10 includes a frame 16 having a feed section 18 for feeding the materials M to be stacked and a conveyor 20 along which a stack and/or bundle S of stacked materials is transported. In a typical arrangement, the conveyor 20 along which the materials M move can be quite long. A stacker chute 22 is preferably inclined at an angle $\alpha$ relative to the conveyor so that the materials to be stacked can be "leaned" rearward to remain in the stacked orientation. In known stackers, the angle of incline $\alpha$ varies from about 10 degrees to about 30 degrees.

The strapper 12 is integrated into the stacker 10, mounted to the stacker frame 16. The strapper 12 includes a strap chute 24 (which defines a strap path) about which the strap traverses. The strap chute 24 is mounted to the frame 16 to assure that it is properly positioned. The strapping machine 12 further includes a single integrated strapping head or a separate feed head and welding head, as indicated generally at 26. For purposes of the present discussion, reference will be made to strapping head 26 and is intended to also include the configuration that includes a separate feed head and welding head. As can be seen from FIG. 3, the strapping head 26 is generally accessible only from the rear of the stacker 10.

Figure 3:
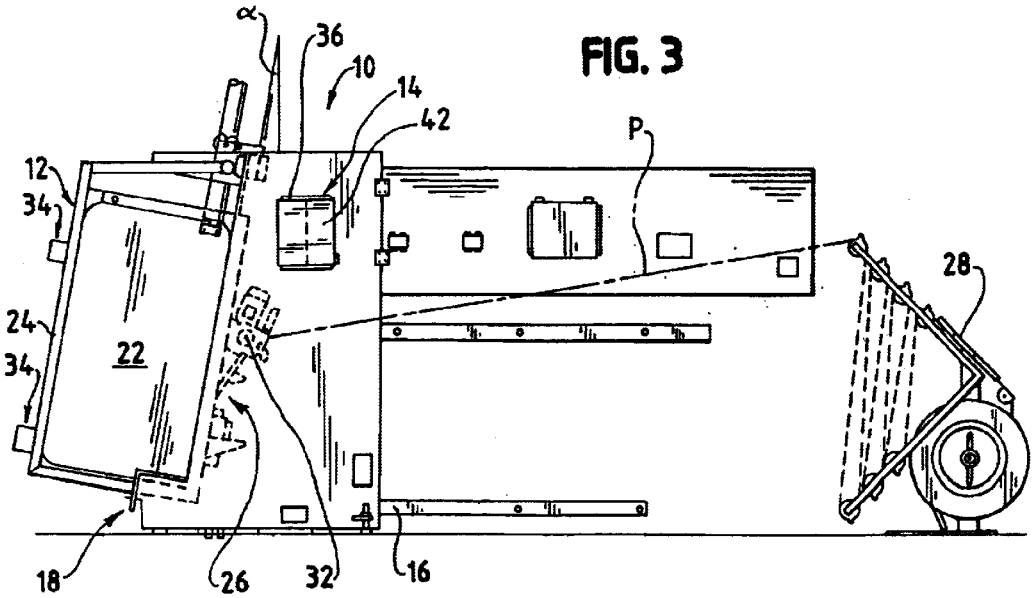
FIG. 3 is a side view of a stacker similar to that shown in FIG. 1, and showing the integral strapping machine.

It will be appreciated that although the materials M to be stacked are referred to as magazines, those skilled in the art will recognize the various items that can be stacked and bundled in such a stacker 10. FIG. 3 illustrates a similar stacker better showing the stacker frame. The illustrated feed section or assembly 18 is exemplary of those used in known stackers.

In operation, materials M are stacked and aligned in the stacker 10. Alignment of the materials facilitates handling and further reduces the damage that may otherwise occur to the materials. Subsequent to stacking a desired volume of material, a rigid element, such as a plywood board, can be placed on top of the material stack S. A similar rigid element can also have been placed on the bottom of the stack so that the stacked material is essentially "sandwiched" between the rigid elements. After stacking and alignment of the materials, and placement of the rigid element on the top of the stack, the stack can be compressed to a desired compression.

Following compression, the bundled material is strapped. Strap P is fed from a supply 28 into the strapper 12. The strap P is conveyed by the strapping head 26 (through the strapping head) and into the strap chute 24. The strap material P traverses through the chute 24 back around to the strapping head 26. A end (that is the first fed end of the strap P) is, upon return to the strapping head, gripped by a gripper (not shown) in the strapping head 26. Feed wheels 32 within the strapping head 26 are actuated to reverse to provide tension in the strap P. When a desired tension is achieved, the strap P is gripped by gripper (not shown) in the strapping head 26. The strap P is then cut to separate the strap from the source and is welded or otherwise sealed onto itself by methods known in the art. The bundled and strapped material is then removed from inside the chute 24 region or strap path and a new stack of material M is positioned therein for strapping.

The strapping operation is carried out as a fully automatic operation. That is, the strap P is fed into and around the chute 24, released and tensioned around the bundle S, welded onto itself and separated from the strap material feed 28, all without operator action or by cycle actuation operation only. There is, however, one or more sensor systems 34 located on the machine that immediately stop the cycle, regardless of the point at which the cycle may be. These sensor systems 34 are part of an interlock system 36 that is intended to enhance operator safety.

Typically, the sensor systems 36 include one or more infrared beam emitters 38 and a receiver 40 associated with each emitter 38. Such a system can also be referred to as a light curtain. Upon a break in the infrared beam, the receiver 40 generates a signal (or terminates a signal) to the interlock system 36 to perform or cease some strapping machine function. For example, in such a system, a break in the infrared beam can result in the isolation of a circuit that permits operation of the strapper 12. Thus, the break in the beam will result in the system stopping operation of the strapper 12. It will be recognized by those skilled in the art that many of these programmed features are part of the overall control or operating system 14 which maybe controlled by a programmable logic controller 42 or like control system.

Once the cycle is stopped, for what ever reason, known strappers must be manually cleared and recycled in order to restart the strapper. The clearing and recycling is manually commenced (as by an operator actuated switch) and ejects any strap from the strapper and "resets" the feed arrangement. Often, the strap must be manually refed into the strapper.

As set forth above, because the strapper section 12 is typically only accessible from the rear of the stacker, it can be quite time consuming to manually recycle and reset the strapper.

The present system uses retained program timers for the safety interlocks 36 to overcome these time consuming operations without sacrificing personnel safety. In a present system, the point (or time) at which the cycle is interrupted is retained in the operation program. After clearing the interlock (not physical clearing of the strapper), the program recommences at the point at which the cycle was interrupted. In this manner, inadvertent cycle interruptions (which have not resulted in misfed or misapplied strap) do not require a strap clearing operation. Rather, if the cycle can be restarted at some mid-point of the cycle, then the cycle will be restarted.

For example, if during the strapping cycle, say after the strap has been conveyed through the chute 24 and back to the strapping head 26, but prior to tensioning, an operator pulls a sheet of paper from the stack S, if the operator "breaks" the sensor 34 beam (or interrupts the light curtain), the system will automatically stop. Known systems would then require that the operator manually clear the machine of the strap in the chute and at the head and recycle the machine to refeed strap into the strapper. This can require the operator to access the strapper components at the rear of the machine, possibly taking a considerably amount of time.

The present system, on the other hand, retains in the program the point at which the cycle was interrupted. In the event that the interruption was caused by a non-strap-fault action (such as inadvertently interrupting the infrared beam), the program (and thus the strapping machine 12) can be automatically restarted at the retained point, or at the point at which the program was interrupted. This restart can be initiated by operator action (as by a manually actuated switch), or automatically carried out by the machine controller 14.

All patents referred to herein, are hereby incorporated herein by reference, whether or not specifically do so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A control system for a strapping machine of the type having a feed assembly, a chute, a strapping head and a control system, the strapping machine configured for operating in a strapping cycle in which strapping material is conveyed into the strapping head, into and around the chute and exits the chute to return to the strapping head, the strapping cycle including receiving first and second courses of strapping material, positioning, tensioning and sealing the strapping material around a load, the control system comprising:

means for determining the presence of a foreign object proximal the strapping machine during the strapping cycle;

means for interrupting the strapping cycle upon determining the presence of a foreign object proximal the strapping machine during the strapping cycle;

means for determining a point of interruption of the strapping cycle; and means for restarting the strapping cycle at the point of interruption.

2. The control system in accordance with claim 1 wherein the means for determining the presence of a foreign object proximal the strapping machine during the strapping cycle is a light actuated sensor system.

3. The control system in accordance with claim 2 wherein the light actuated sensor system is a light curtain.

4. The control system in accordance with claim 1 wherein the means for restarting the strapping cycle at the point of interruption is a manual switch.

5. The control system in accordance with claim 1 wherein the means for restarting the strapping cycle at the point of interruption is a automatic.

6. The control system in accordance with claim 1 wherein the means for determining the point of interruption of the strapping cycle is a retained program timer.

7. A method for restarting a strapping machine that has been interrupted during a strapping cycle, the strapping machine of the type having a feed assembly, a chute, a strapping head and a control system, the strapping cycle including starting the strapping cycle, conveying a strapping material into the strapping head, into and around the chute and to exit the chute and return to the strapping head, the cycle including receiving first and second courses of strapping material at the strapping head, positioning the strapping material around a load, tensioning the strapping material around the load, sealing the strapping material onto itself and severing the strapping material from a strapping material source, the method comprising the steps of:

detecting the presence of a foreign object at the strapping machine chute and interrupting the strapping cycle based upon the presence of the foreign object;

detecting that the strapping cycle has been interrupted;

determining a point of interruption of the strapping cycle; and restarting the strapping cycle at the point of interruption.

8. The method for restarting a strapping machine in accordance with claim 7 wherein the step of restarting the strapping cycle includes the step of manually actuating a switch to restart the strapping cycle.

9. The method for restarting a strapping machine in accordance with claim 7 wherein the step of detecting the presence of a foreign object includes the step of breaching a light curtain.

* * * * *